US005765884A

United States Patent [19]

Armbruster

[11] Patent Number: 5,765,884

[45] Date of Patent: Jun. 16, 1998

[54] MOTOR-VEHICLE DOOR LATCH AND METHOD OF OPERATING SAME

[75] Inventor: Stefan Armbruster, Essen, Germany

[73] Assignee: Kiekert AG, Heiligenhaus, Germany

[21] Appl. No.: 707,463

[22] Filed: Sep. 4, 1996

[30] Foreign Application Priority Data

Sep. 8, 1995 [DE] Germany ..... 195 33 193.1

[51] Int. Cl.[6] ..... E05C 3/16

[52] U.S. Cl. ..... 292/216; 292/201; 292/1

[58] Field of Search ..... 292/201, DIG. 43, 292/216, DIG. 14

[56] References Cited

U.S. PATENT DOCUMENTS

| | | | |
|---|---|---|---|
| 3,332,713 | 7/1967 | Clajre | 292/201 |
| 4,821,521 | 4/1989 | Schuler | 292/201 X |
| 4,843,849 | 7/1989 | Kamke et al. | 292/201 X |
| 4,889,371 | 12/1989 | Girard et al. | 292/201 |
| 5,222,775 | 6/1993 | Kato | 292/216 X |
| 5,238,274 | 8/1993 | Becker et al. | 292/201 |
| 5,351,439 | 10/1994 | Takeda et al. | 49/28 |

FOREIGN PATENT DOCUMENTS

| | | | |
|---|---|---|---|
| 3150620 | 6/1983 | Germany | 292/201 |
| 2-58684 | 8/1988 | Japan | 292/201 |

*Primary Examiner*—Rodney M. Lindsey

*Attorney, Agent, or Firm*—Herbert Dubno; Andrew Wilford

[57] ABSTRACT

A door latch has a latch mechanism including a drive element movable between a position corresponding to a closed condition of a vehicle door, a position corresponding to an open condition of the door, and an end reference end position offset from the closed and open positions and engaging a fixed abutment. An electric-motor drive connected to the mechanism can move the element between the closed and open positions and into the end reference position. A hall-effect sensor detects the current position of the element and a controller is connected to the sensor to operate the drive. After each displacement of the element from one of the open and closed positions to the other of the open and closed positions, the element is displaced into the end reference position and the controller is initialized while the element is in the end reference position. Thereafter the element is returned to the other of the open and closed positions. The sensor is made to pulse by a magnet carried on the shaft of a rotary electric motor connected via a stepdown transmission to the drive element.

5 Claims, 2 Drawing Sheets

MOTOR-VEHICLE DOOR LATCH AND METHOD OF OPERATING SAME

FIELD OF THE INVENTION

The present invention relates to a motor-vehicle door latch. More particularly this invention concerns a method of operating such a latch.

BACKGROUND OF THE INVENTION

In my earlier patent application Ser. 08/650,135 filed 17 May 1996 I describe a motor-vehicle door latch having a housing and a fork formed with a detent and pivotal about a main axis on the housing from a latched position retaining a bolt deep in the housing, a semilatched position retaining the bolt shallow in the housing, and an unlatched position permitting the bolt to enter and exit the housing. A main rocker can pivot about the main axis on the housing with the fork between the latched and semilatched positions and a drive is connected to the main rocker for pivoting same about the main axis between the latched and semilatched positions. A pawl pivoted on the main rocker about a secondary axis offset from the main axis is provided offset from the axes with an axially projecting actuator pin and can move between an inner position engaging the detent and rotationally coupling the fork to the main rocker and an outer position clear of the detent and permitting the fork to rotate independently of the main rocker. A secondary rocker pivoted on the main axis is provided with a cam formation having a lifting portion engageable with the actuator pin to displace the pawl from its inner position to its outer position and a holding portion engageable with the actuator pin to retain it in its outer position. A coupling and formations on the fork and main rocker in the semilatched position hold the pawl with the holding portion in the outer position and in the unlatched position hold the actuator pin out of engagement with the holding portion.

The coupling works with delayed action or lost motion to force the secondary rocker to follow the movements of the main rocker, but with a minor delay. The coupling establishes when the actuator pin is on the lifting portion or holding portion of the secondary rocker. The holding portion is set up such that the pawl is held completely off the fork and the lifting portion, which ends where the holding portion starts, serves to lift the pawl on relative shifting of the main and secondary rockers.

When the door is closed the actuator pin is on the lifting portion so that the closing movement can be interrupted and even reversed at any time, without having to reach the end closed position. Thus if, for instance, a finger gets caught in the door the drive can be reversed instantaneously to release it. Since the pawl is held clear of the fork in the open-ready position, it cannot engage the forks detent before the fork has freed the bolt, that is when the latch is fully opened.

Such a latch is particularly suitable for use with a trunk lid, with the latch itself mounted on an edge of the opening the lid fits to and the bolt being provided on the lid itself. The drive motor can be operated by a bistable relay which in the off position latches the lid and in the on position opens it. A switch which may also be remotely controlled can operate this relay. Normally the drive motor is a stepping motor which can be incorporated in a system for aligning the lid properly. During the original installation of the door the drive motor is moved in steps until the door is perfectly aligned in its opening and this position is recorded. Subsequently each time the door is closed, the drive motor is stepped to the same position to reproduce the desired alignment. If, however, a step missed or the control means miscounts, the door is henceforth permanently set in a nonflush position when closed.

A gallium-arsenide hall-effect sensor associated with the drive element reports back to the controller the current position of this element. It produces a hall voltage which varies with the strength of a magnet it is associated with, so that a generally analog signal can be produced by the hall-effect sensor indicating the angular or linear position of the drive element. The system can also work digitally with the hall-effect sensor emitting pulses that are counted. Either way the drive element is typically moved between a pair of end positions corresponding to the open and closed positions of the latch. On installation the closed position is set so that the door is thereafter returned to this position, exactly flush with the vehicle. Thus one position is in theory fixed while the other is set at a predetermined spacing from this position. Once again, if the controller loses track by, for instance, missing a pulse from the sensor, the end positions will be incorrect.

OBJECTS OF THE INVENTION

It is therefore an object of the present invention to provide an improved motor-vehicle door latch.

Another object is the provision of such an improved motor-vehicle door latch which overcomes the above-given disadvantages, that is which operates in a simple manner so that, once set, it will always return the door to a perfectly flush position.

SUMMARY OF THE INVENTION

A door latch has a latch mechanism including a drive element movable between a position corresponding to a closed condition of a vehicle door, a position corresponding to an olden condition of the door, and an end reference end position offset from the closed and open positions and engaging a fixed abutment. An electric-motor drive connected to the mechanism can move the element between the closed and open positions and into the end reference position. A hall-effect sensor detects the current position of the element and a controller is connected to the sensor to operate the drive. According to the invention, after each displacement of the element from one of the open and closed positions to the other of the open and closed positions, the element is displaced into the end reference position and the controller is initialized while the element is in the end reference position. Thereafter the element is returned to the other of the open and closed positions.

The abutment according to the invention is normally fixed on the latch housing, the drive element being movable on the latch housing. The initializing is normally a resetting of the controller, to zero in a digital setup and to some particular level in an analog one. During each actuation cycle of the latch, normally after movement from the open to the closed position, the drive motor continues actuation of the drive element sufficiently that, even if the setting has been lost, it will be sure to engage the abutment, whereupon the controller is initialized and moved back into the closed position. Thus with the system of this invention the open and closed positions are defined relative to the end reference position which is mechanically defined and with each actuation this base position is again ascertained. Thus errors do not accumulate in the controller so that even if, for instance, a pulse is not counted this miscount will only affect the current operating cycle and will be eliminated with the next actuation.

According to the invention the drive includes an output shaft on the electric motor, a magnet carried on and rotatable with the shaft and juxtaposed with the hall-effect sensor so that with each revolution of the shaft the sensor emits a pulse, and a stepdown transmission connected between the output shaft and the drive element. Thus each pulse will actually represent a small angular movement at the output side of the transmission, which is normally directly connected to the drive element. The controller includes a resettable counter connected to the sensor and a nonvolatile memory holding a count equal to the number of pulses between a one of the open and closed positions and the end reference positions. Thus the controller knows how many pulses between each of the open and closed positions and the end reference position.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
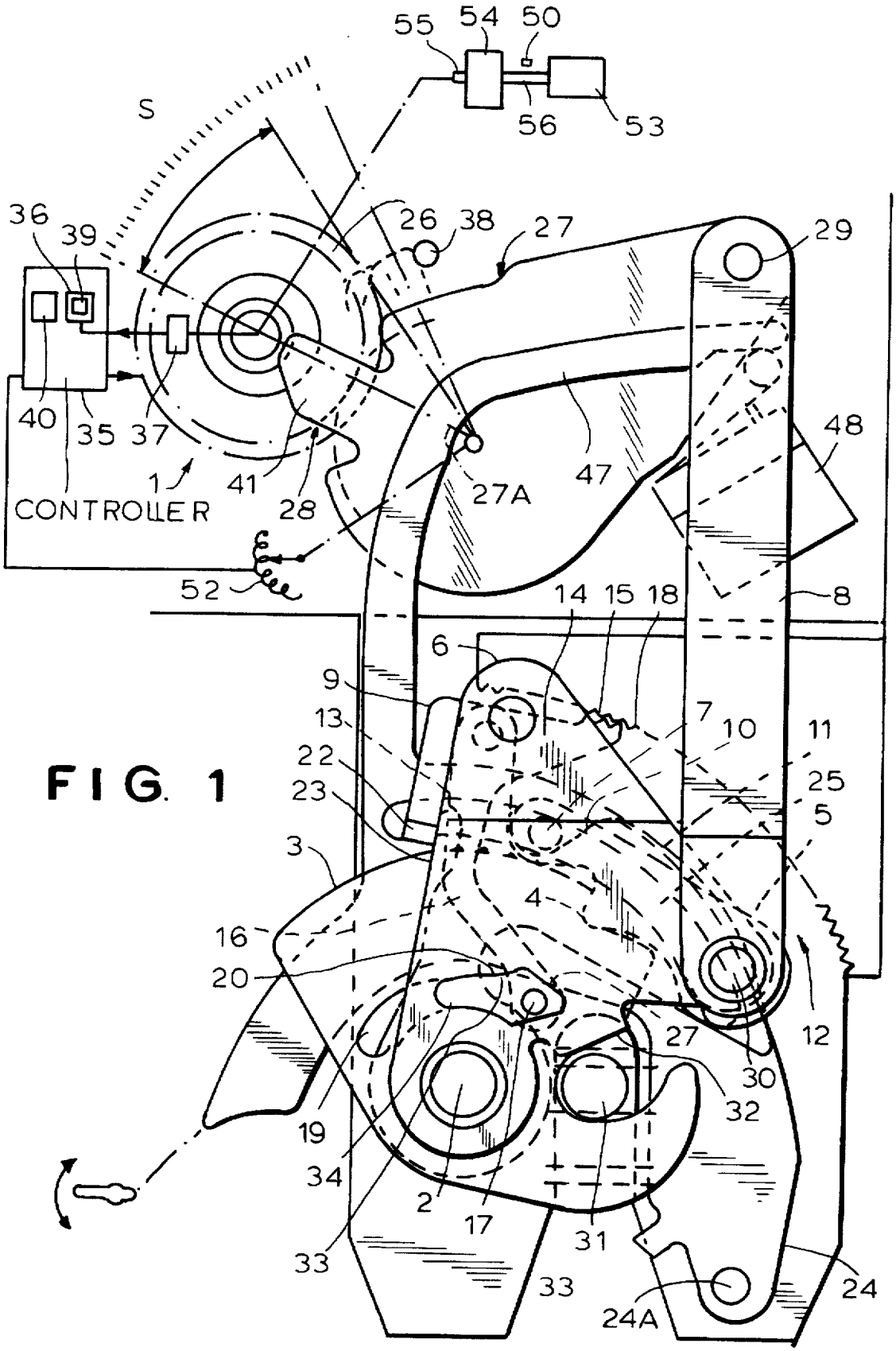
FIG. 1 is a partly schematic view of the latch according to the invention.
Figure 2:
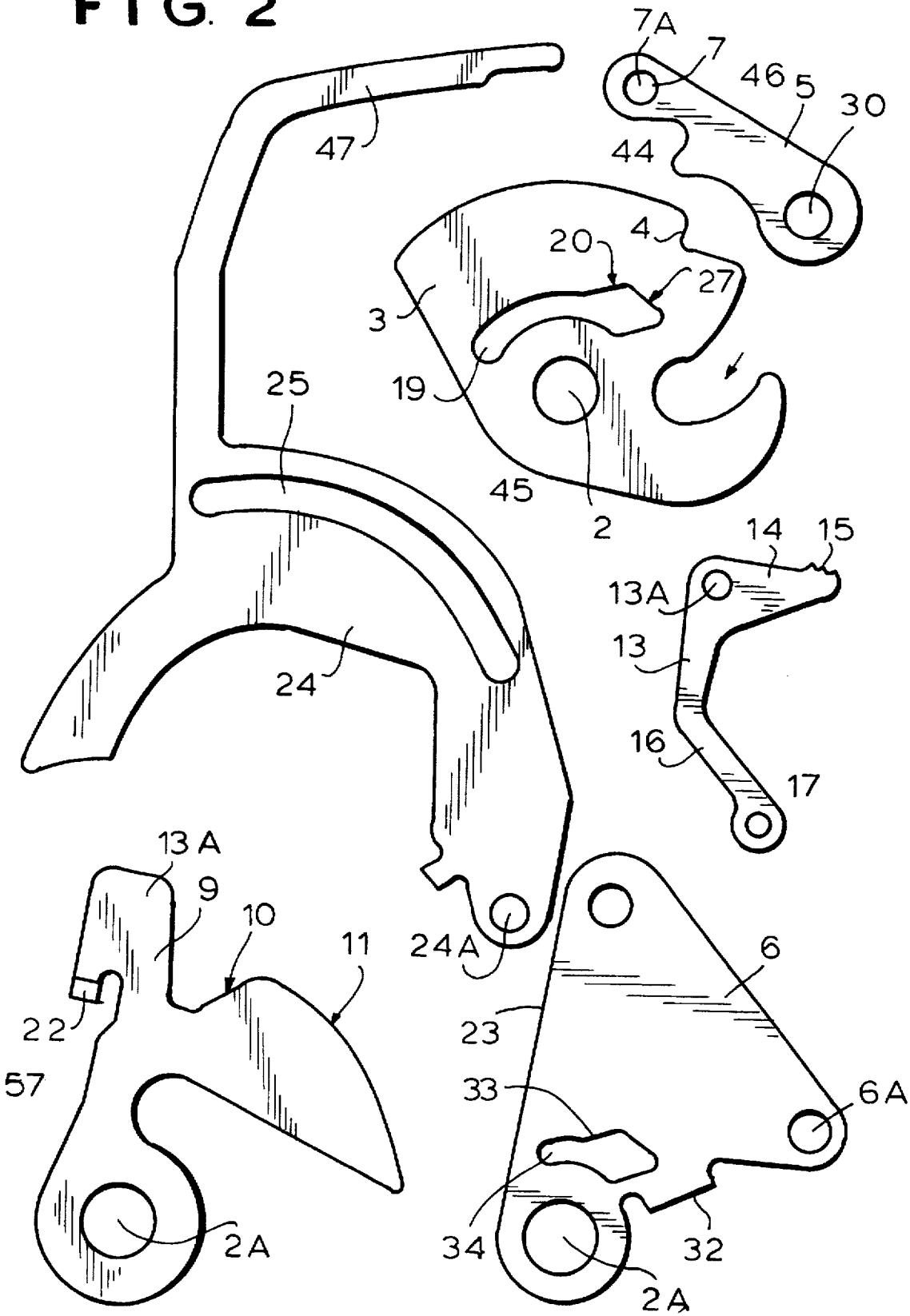
FIG. 2 is an exploded view showing the major elements of the latch.

As seen in FIGS. 1 and 2 a latch according to the invention is powered by a rotary drive 1 comprised of a motor 53 having an output shaft 56 connected via a stepdown transmission 54 to a shaft 55 carrying a gear 26. The latch has a housing 42 normally secured in a motor-vehicle body adjacent a trunk lid having a latching bolt 31, although it would be standard to mount the latch housing 42 in the door with the bolt 31 on the door post. A fork 3 mounted on a pivot 2 defining a main axis 2A has a mouth 43 that can engage around the bolt 31 which in the closed position is adjacent and parallel to the pivot 2. A torque spring illustrated schematically in FIG. 2 at 45 urges the fork 3 toward an open position described below. An outwardly open detent recess or notch 4 is formed in the fork 3 and a pawl 5 formed with a hole 30 defining a pivot axis 6A is carried on a first or main rocker plate 6 pivotal about the axis 2A. This pawl 5 has a tooth 44 and is urged radially toward the fork 3 by a torque spring 46 so that the tooth 44 can in the closed position engage the detent 4 and hold the fork 3 against pivoting in the clockwise opening direction. The rocker plate 6 has an edge tab 32 engageable with the bolt 31 as described below. An actuating pin 7 extends along an axis 7A parallel to the axes 2A and 6A from the outer end of the pawl 5.

A rigid pusher link 8 has a lower end pivoted on the rocker plate 6 at 6A and an upper end pivoted at 29 on a sector-like drive element 27 pivotal about an axis 27A and having teeth 28 meshing with the teeth of a pinion 26 carried on the reversible drive motor 1. Thus this drive 1 can angularly displace the plate 6 and thereby, when the tooth 44 is engaged in the detent 4, also pivot the fork 3. The motor 1 is a stepping-type motor operated by a central controller 35. This drive element 27 is formed with a radially extending arm 41 that can engage a stop or abutment 38 fixed on the housing 42.

According to the invention a secondary rocker plate 9 also carried on the pivot 2 has an angled control edge 10 that can engage the pin 7 and cam the pawl 5 into an outer position in which its tooth 44 is unengageable with the detent 4. The secondary rocker 9 also has a circularly arcuate control edge 11 that is centered on the axis 2A and spaced therefrom by a distance such that when it engages the pin 7 it holds the pawl 5 out of contact with the fork 3. This secondary rocker 9 also has a laterally bent-out tab 22 that can engage an edge 23 of the main rocker 6, another torque spring 57 being provided to urge the rocker 9 clockwise so that, unless something is preventing it, the tab 22 normally rests against the edge 23 and the rockers 6 and 9 pivot together.

A lost-motion or delayed-action coupling 12 is provided between the secondary rocker 9 and the main rocker 6 so that the secondary rocker 9, which is responsible for disengaging the pawl 5 from the fork 3, does not move with the main rocker 6 at the start of its opening movement. This coupling 12 is constituted as a two-arm lever 13 having a pivot at 13A on the rocker 9 and an outer arm 14 formed with teeth 15 engageable with teeth 18 formed in the housing 42 in an arc centered on the axis 2A and another leg 16 having at its end a second coupling pin 17 extending parallel to the axes 2A, 6A, 7A, and 13A. This pin 17 engages through slots 19 and 34 respectively formed in the fork 3 and the main rocker 6 and generally extending arcuately centered on the axis 2A. The slot 19 has an enlarged end which is formed with a pair of camming flanks 20 and 21 and which allows the pin 17 to assume an outermost position in which its teeth 15 engage the teeth 18 to lock the lever 13 as well as the rocker 9 against rotation about the axis 2A. The slot 34 is similarly formed with an enlarged end 33 and the enlarged ends of the slots 19 and 34 are axially aligned in the fully closed position of FIG. 1. A torque spring illustrated schematically at 49 urges the lever 13 so that its teeth 15 are biased into engagement with the teeth 18.

An actuating lever 24 is pivoted at an axis 24A offset from the axis 2A on the housing 42 and has an arcuate slot 25 generally centered on the axis 2A. This lever 24 has an arm 47 engageable with a switch 48 connected to the controller 35. The pin 7 passes through the slot 25 and when the pawl 5 is pushed out to release the fork 3 the arm 47 is pivoted to actuate the switch 48. Thus the switch 48 can report when the system is latched. An inside actuating lever 51 is directly connected to this lever 24 for manually operating it.

This system operates as described and illustrated in the above-cited copending application: First of all the motor 1 rotates the gear 26 counterclockwise to oppositely pivot the crank 27 and push down the link lever 8. This action initially moves the pivot axis 6A down, allowing the pawl 5 and fork 3 to pivot clockwise along with the main rocker 6. The secondary rocker 9 does not move because the pin 17 is engaged in the enlarged ends of the slots 19 and 34 and the teeth 15 and 18 are therefore engaged so that the arm 13 and the rocker 9 it is mounted on are held against pivoting. The edge 23 separates from the tab 22. This puts the latch in the semilatched condition with the fork 3 pivoted out somewhat but the tooth 44 still engaging the detent 4. In this position, however, the pin 7 is starting to ride up on the cam edge 10 of the stationary secondary rocker 9 to pull the pawl 5 away from the fork 3.

Once the tooth 44 clears the detent 4, the fork 3 can pivot out under the force of its spring 45. The pin 17 moves into the narrow part of the slot 19 of the moving fork 3 so that the lever 13 is pivoted in and the teeth 15 are pulled out of engagement with the teeth 18, thereby freeing the secondary plate 9 to pivot until the tab 22 engages the edge 23. During subsequent pivoting of the plate 6 by the motor 1 the plate 9 will follow until the pin 17 moves back into the enlarged end of the slot 19 and the arm 13 again pivots out and engages its teeth 15 with the teeth 18, thereby again arresting the arm 13 and plate 9. This second stopping of the rocker plate 9 is necessary in order to hold the pin 7 of the pawl 5 on the edge 11, maintaining the pawl 5 in an outer position out of contact with the fork 3.

When the door, here the trunk lid, is then physically opened the fork 3 is pivoted all the way out and its slot 19 again engages the pin 17 and once again disengages the teeth 15 and 18 from each other, allowing the plate 9 to once again come to rest with its tab 23 against the edge 22.

If the trunk lid is not opened, for instance because it is covered by snow or otherwise stuck shut, the tab 32 will strike the bolt 31 with some force and should move it at least a little. Then the cam end 33 will be effective to keep the teeth 15 disengaged from the teeth 18.

When the trunk lid is pushed to, the bolt 31 will engage the fork 3 and pivot it back until the pawl 5 catches on the detent 4 again, thereby signalling to the motor 1 via the lever 24 that it should reverse rotate and fully close the latch. The link 8 is moved up and the first rocker plate 6 is also pivoted back as the bolt 31 engages the tab 32. The cam surface 21 engages the pin 17 to pivot in the arm 13 and keep the teeth 15 disengaged from the teeth 18. During the closing operation the release pin 7 is always near the control surface 10 so that at any time the closing movement can be stopped and reversed. Thus if for example something gets stuck between the door and its opening, the door can be opened immediately before damage or injury is serious.

According to the invention a schematically illustrated magnet 50 on the shaft 56 cooperates with a hall-effect sensor 37 connected to an input circuit 36 of the controller 35. A counter 39 forming part of this input circuit 36 counts the number of steps S the element 26 is moved through by the drive 1, which is done by mounting the magnet 50 on the shaft 56 between the motor 53 and the stepdown transmission 54 so that each rotation of the motor shaft 56, which corresponds to a small angular displacement S of the element 26, represents a single pulse or step. The controller 35 has a register or memory 40 in which is stored the position of the element 26 necessary for the respective door to be exactly flush with the car body, typically as the number of steps S removed from a reference position in which the arm 41 abuts the stop 38. In addition a potentiometer mounted on the frame 42 has a wiper connected to the shaft of the crank element 27 to produce an analog resistance output that is fed to the controller 35 and that is indicative of the angular position of the element 27.

Here the closed position when the door is perfectly flush with the car body is shown by the solid-line position of the arm 41, the open position is shown as a dotted line, and the reference position of the arm 41 against the abutment is shown in a dashed line. The element 26 must be moved through the number n of steps S to move from the open position to the closed position exactly flush with the adjacent car body. This number n is determined during initial setup of the machine, typically during manufacture of the vehicle, and is stored in the memory 40. It is-determined with respect to the dashed-line reference position.

In accordance with this invention each time the latch is opened, that is moved from the solid-line position, the element 26 is displaced further to the dashed-line reference position and at this point the counter 39 is reset or initialized. Thus even if the controller 35 has miscounted, its nonvolatile memory 40 will be able to determine the proper closed position of the door controlled by the latch of this invention, simply by moving the appropriate number n of steps S past the dotted-line open position. If the setting is lost, the controller 35 can make a somewhat less accurate determination of the position of the mechanism from the output of the potentiometer 52 to allow the latch to operate, although normally it will have to be reset in the shop for exact flush alignment of the door in the closed position.

I claim:

1. A method of operating a door latch having a latch mechanism including a latch pawl and fork operable to secure a motor-vehicle door relative to a motor-vehicle body;

a drive element movable about a drive axis between a position corresponding to a closed condition of the vehicle door, a position corresponding to an open condition of the door, and an end reference end position offset from the closed and open positions, the drive element being formed with gear teeth and with a radially projecting arm;

a rigid link pivoted on the drive element offset from the drive axis and on the latch pawl for actuation of the pawl by the element;

a fixed abutment engageable with the arm of the element only in the end reference position thereof;

a reversible electric-motor drive carrying an output gear meshing with the gear teeth of the element and operable to move the element between the closed and open positions and into the end reference position;

a hall-effect sensor for detecting the current position of the element; and a controller connected to the sensor for operating the drive, the method comprising the steps of:

after each displacement of the element from one of the open and closed positions to the other of the open and closed positions, displacing the element into the end reference position and initializing the controller while the element is in the end reference position; and thereafter returning the element to the other of the open and closed positions.

2. A motor-vehicle door latch comprising:

a latch mechanism including a latch pawl and fork operable to secure a motor-vehicle door relative to a motor-vehicle body;

a drive element movable between a closed position corresponding to a closed condition of the motor-vehicle door, an open position corresponding to an open condition of the door, and an end reference position offset from the open and closed positions, the drive element being formed with gear teeth and with a radially projecting arm;

a rigid link pivoted on the drive element offset from the drive axis and on the latch pawl for actuation of the pawl by the element;

a fixed abutment engageable with the arm of the element only in the end reference position;

means including a hall-effect sensor operatively coupled to the drive element for producing an output indicating the current position of the element;

drive means including a reversible electric motor carrying an output gear meshing with the gear teeth of the element for displacing the element between its positions; and control means connected to the drive means and sensor for, after each displacement of the element from one of the open and closed positions to the other of the open and closed positions, displacing the element into the end reference position and initializing the controller and thereafter returning the element to the other of the open and closed positions.

3. The motor-vehicle door latch defined in claim 2 wherein the drive means further includes:

an output shaft on the electric motor, a magnet carried on and rotatable with the shaft and juxtaposed with the hall-effect sensor, whereby with each revolution of the shaft the sensor emits a pulse, and a stepdown transmission connected between the output shaft and the drive element.

4. The motor-vehicle door latch defined in claim 3 wherein the control means includes a resettable counter connected to the sensor.

5. The motor-vehicle door latch defined in claim 4 wherein the control means includes a memory holding a count equal to the number of pulses between a one of the open and closed positions and the end reference positions.

* * * * *